US006885813B2

(12) United States Patent
Buzzi

(10) Patent No.: US 6,885,813 B2
(45) Date of Patent: Apr. 26, 2005

(54) DISPOSABLE STEAM GENERATOR FOR DOMESTIC STEAM APPLIANCES

(75) Inventor: Bruno Buzzi, Turin (IT)

(73) Assignee: De'Longhi S.p.A., Treviso (IT)

( * ) Notice: Subject to any disclaimer, the term of this patent is extended or adjusted under 35 U.S.C. 154(b) by 210 days.

(21) Appl. No.: 10/240,391

(22) PCT Filed: Mar. 26, 2001

(86) PCT No.: PCT/EP01/03403

§ 371 (c)(1),
(2), (4) Date: Sep. 30, 2002

(87) PCT Pub. No.: WO01/74129

PCT Pub. Date: Oct. 11, 2001

(65) Prior Publication Data

US 2003/0108343 A1 Jun. 12, 2003

(30) Foreign Application Priority Data

| | | |
|---|---|---|
| Mar. 31, 2000 | (IT) | T02000A0306 |
| Jun. 29, 2000 | (IT) | T02000A0644 |
| Jun. 29, 2000 | (IT) | T02000A0645 |
| Oct. 17, 2000 | (IT) | T02000A0971 |

(51) Int. Cl.[7] ..... F17C 7/04
(52) U.S. Cl. ..... 392/403; 392/386; 392/405
(58) Field of Search ..... 392/386, 390, 392/391, 394, 400, 402, 405, 406

(56) References Cited

U.S. PATENT DOCUMENTS

| | | | | |
|---|---|---|---|---|
| 4,246,871 A | * | 1/1981 | Bocksruker et al. | 122/4 A |
| 6,295,691 B1 | * | 10/2001 | Chen | 15/321 |

FOREIGN PATENT DOCUMENTS

| | | |
|---|---|---|
| DE | 39 41 322 A | 6/1991 |
| FR | 715 764 A | 12/1931 |
| FR | 2 691 233 A | 11/1993 |
| FR | 2 778 969 A | 11/1999 |
| GB | 1 201 263 A | 8/1970 |
| IT | TO980053 U | 9/1999 |
| US | 4 320 702 A | 3/1982 |

* cited by examiner

*Primary Examiner*—Thor Campbell
(74) *Attorney, Agent, or Firm*—Sughrue Mion, PLLC

(57) ABSTRACT

Disposable steam generator (1') for domestic steam appliances, comprising a base (2') that is applicable permanently to the steam appliance, a hollow body (3') that forms the steam chamber (14') and is connected to the base (2') so as to be removable and replaceable, and at least one electric heating element (6'). The heating element (6') is attached to the base (2'), which has a seat (4') in which the hollow body (3'), of a complementary shape, fits tightly, in close contact for heat transfer, but in a manner that makes it rapidly removable.

26 Claims, 7 Drawing Sheets

DISPOSABLE STEAM GENERATOR FOR DOMESTIC STEAM APPLIANCES

This is a National stage entry under 35 U.S.C. §371 of Application No. PCT/EP01/03403 filed Mar. 26, 2001; the disclosure of which is incorporated herein by reference.

BACKGROUND OF THE INVENTION

The present invention refers to domestic steam appliances in general, e.g. irons, cleaners, coffee makers, and the like.

To be more specific, the invention concerns a steam generator that can be used with such appliances, comprising a hollow body made of a heat-conducting material which defines a steam generating chamber with a water inlet and a steam outlet, and at least one electric heating element.

Such steam generators are defined as "instantaneous", as opposed to the usual storage boilers, and are used particularly in applications where steam must be delivered in relatively small quantities in a substantially continuous flow.

STATE OF THE PRIOR ART

Conventionally, these steam generators are applied permanently to the corresponding appliances, or they may only be dismantled by specialized technicians with the aid of suitable tools. This poses considerable problems in relation to the periodical cleaning of the boiler, which is necessary to remove scale deposits that can obstruct the passage of the water and steam through the steam chamber. For such cleaning operations, the steam appliance may be out of service for quite a lengthy period of time, with consequent inconvenience and costs.

To overcome this problem, it has been suggested that the steam generator should be made more easily and rapidly removable and replaceable with respect to the domestic appliance it serves.

A known solution in this sense is described and illustrated in the European patent EP-B-0 654 635, according to which the steam generator comprises a body composed of a removable tank connected with a rapid coupling to a fixed part of the steam generator by means of elastic clips. The electric heating element is attached directly to said tank, i.e. to the hollow body that forms the steam chamber, because in practice this is the only way to guarantee an effective steam delivery from the generator.

A similar arrangement is also described and illustrated in the Italian patent application IT-A-TO98A886, presented in the name of the same applicant. Here again, the electric heating element is incorporated in the removable hollow body that forms the steam chamber of the generator. Safety devices are provided to prevent the hollow body from being detached from the appliance when its temperature is in excess of an established value.

Though these know solutions solve the problem outlined in the beginning, in that they allow for the removal and replacement of the steam chamber when its operation is prejudiced by scale deposits, they present the drawback of being extremely costly: in fact, together with the hollow body,the heating element, which in practical terms forms an integral part of the disposable assembly, is also removed.

It would be better, however, for obvious reasons of simplicity and cost reduction, to remove and replace only the steam chamber that is clogged with scale, without having to remove the heating element too.

SUMMARY OF THE INVENTION

The present invention proposes essentially to achieve said aim, obtaining said result by means of the fact that:

said base is designed to be attached permanently to the steam appliance and said hollow body is designed for a rapid connection, in a replaceable manner, to the base, said at least one electric heating element is attached to the base, said base is also made of heat-conducting material and has a seat, the hollow body has at least in part a shape complementary to that of said seat in the base and fits tightly, in close heat-transfer contact and in a releasable fashion, with and said seat.

Thanks to this solution, between the hollow body that forms the replaceable, or "disposable", steam chamber and the base that is attached permanently to the steam appliance, a contact area that enables heat transfer essentially by conduction is achieved in order to guarantee an effective, optimal steam production by the generator even though the heating element is attached to the base—and is therefore also permanently attached to the steam appliance instead of being attached to the hollow body, as in the already-known implementation described above.

In order to further improve the aforementioned contact area for heat transfer, the invention can conveniently include the presence of thrust-inducing means designed to apply an axial pressure to hold said body and said base against each other.

A further drawback of the known steam generators of the type described above is related to the electric power supply to the heating element. Said heating element can generally be connected to a source of electrical energy by means of normally-closed safety thermostatic switching means, which are generally composed of a single thermostatic switch that is sensitive to the temperature inside the steam chamber (in addition to an irreversible temperature limiter in the form of a fuse or the like). Said thermostatic switch is designed to open at a threshold temperature of around 170° C. so as to cut off the power supply to the heating element once said threshold temperature has been reached. During steam production, said temperature is reached relatively quickly and the thermostatic switch consequently opens cyclically, closing again as soon as the temperature inside the steam chamber drops below the opening threshold. With this type of arrangement, the quality of the steam produced by the generator is relatively modest, because it deteriorates drastically every time the thermostatic switch opens on reaching its temperature threshold.

A further, secondary aim of the present invention is to overcome said drawback and, more in particular, to achieve a steam generator of the kind defined above that is capable, in a relatively straightforward and economical manner, of constantly ensuring a steam delivery that is more regular and therefore of better quality.

According to the present invention, this further aim is achieved thanks to the fact that the aforementioned thermostatic switching means include a first thermostatic switch set for a first opening temperature, whose operation is associated with the above-mentioned water inlet, and a second thermostatic switch set for a second opening temperature that is substantially higher than said first thermostatic switch's opening temperature and whose operation is associated with the steam chamber.

Typically, the opening temperature for the first thermostatic switch can be between approximately 90 and 150° C., and the opening temperature for the second thermostatic switch can be between approximately 170 and 200° C.

Thanks to this solution, during the operation of the steam generator in a steady state, thermostatic control is entrusted—under normal conditions—to the first thermostatic switch, which is rapidly closed again every time it opens, thanks to the cooling effect of the water delivered to the generator's inlet. By taking suitable action on the balance between the power of the electrical energy supply, the heating mass of the body and the quantity of water delivered to its inlet, the temperature inside the steam chamber is maintained constantly below the opening temperature threshold of the second thermostatic switch, so the heating element is practically powered in a distinctly less intermittent manner. In this way, the steam production is more regular and constant, and therefore of better quality.

BRIEF DESCRIPTION OF THE DRAWINGS

The invention is now described in detail with reference to the attached drawings, which are provided purely by way of example and in no way restrict the scope of the invention, in which.

DETAILED DESCRIPTION OF THE INVENTION

Referring initially to FIGS. 1 to 4, in a first form of implementation of the invention, 1 is used to indicate the disposable steam generator as a whole, which is applicable, for instance, to irons, cleaners, coffee makers, and other such domestic steam appliances.

The steam generator 1 essentially comprises a base 2, designed to be attached permanently to the steam appliance (using conventional methods that, for the sake of simplicity, are not illustrated here since they are easily accessible to any technician in this sector), and a hollow body 3 designed for a rapid coupling, in a removable and replaceable fashion, with the base 2.

Figure 1:
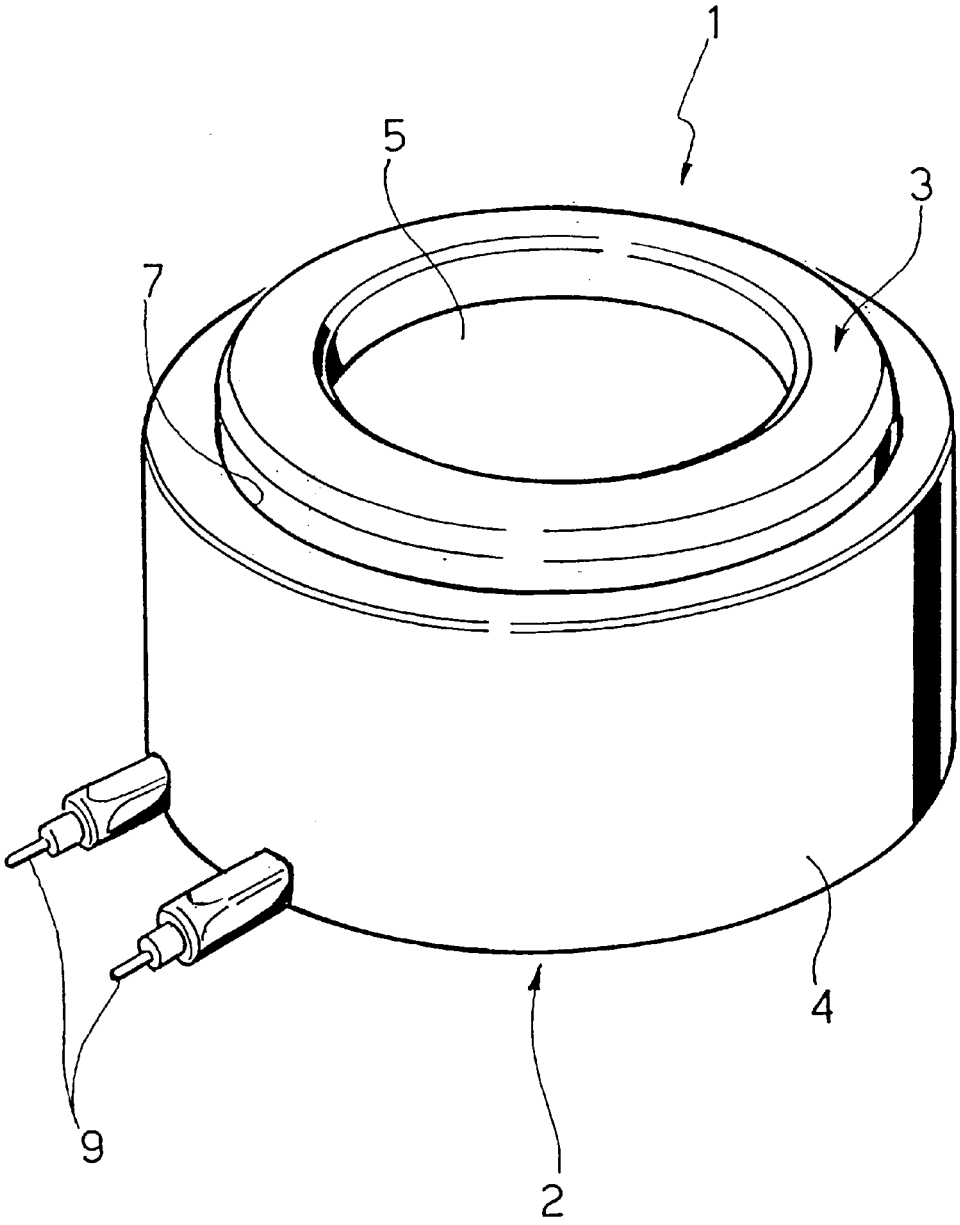
FIG. 1 is a schematic perspective view of a first preferred form of implementation of the disposable steam generator made according to the present invention.
Figure 2:
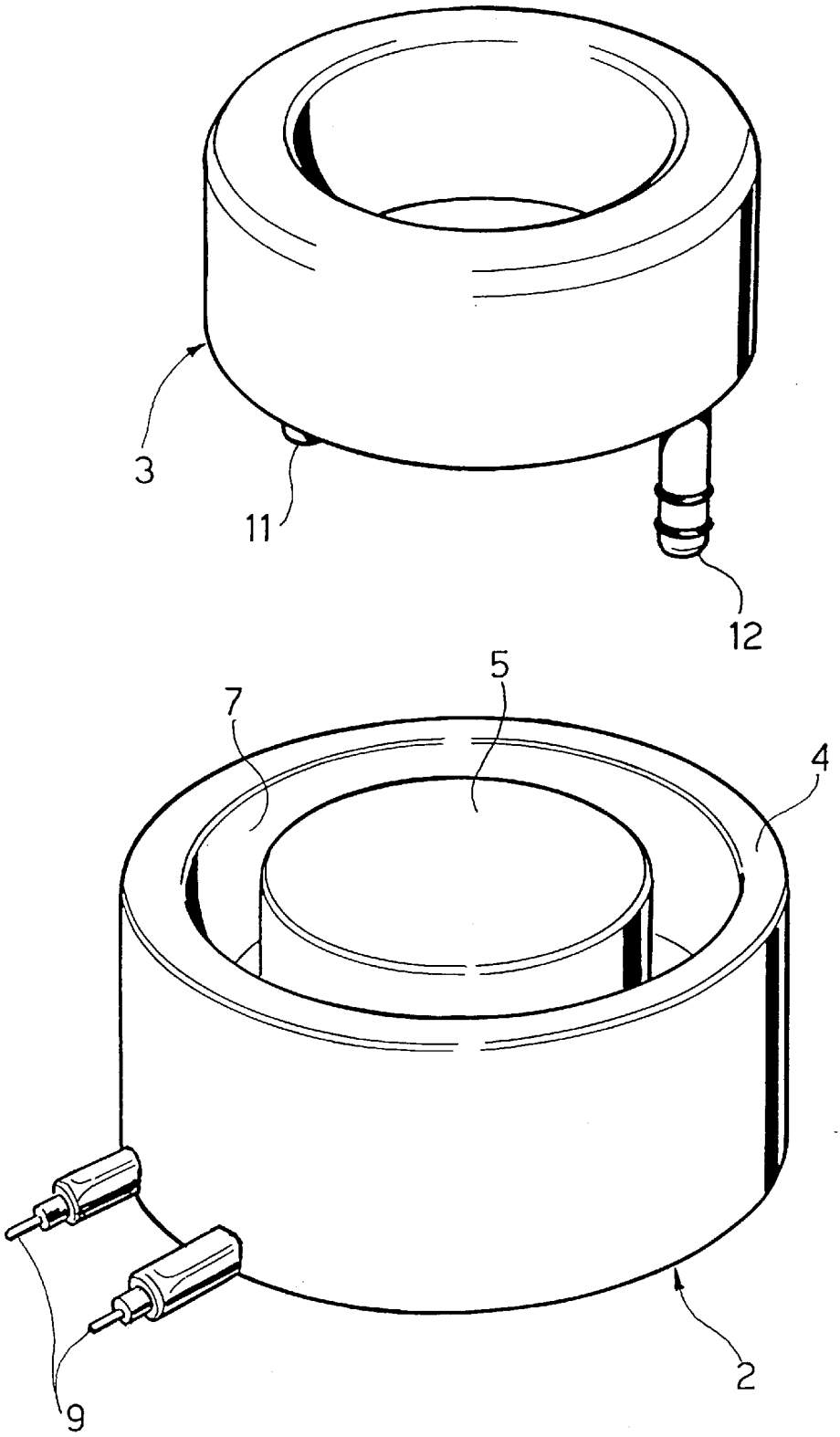
FIG. 2 is an exploded view of FIG. 1.
Figure 4:
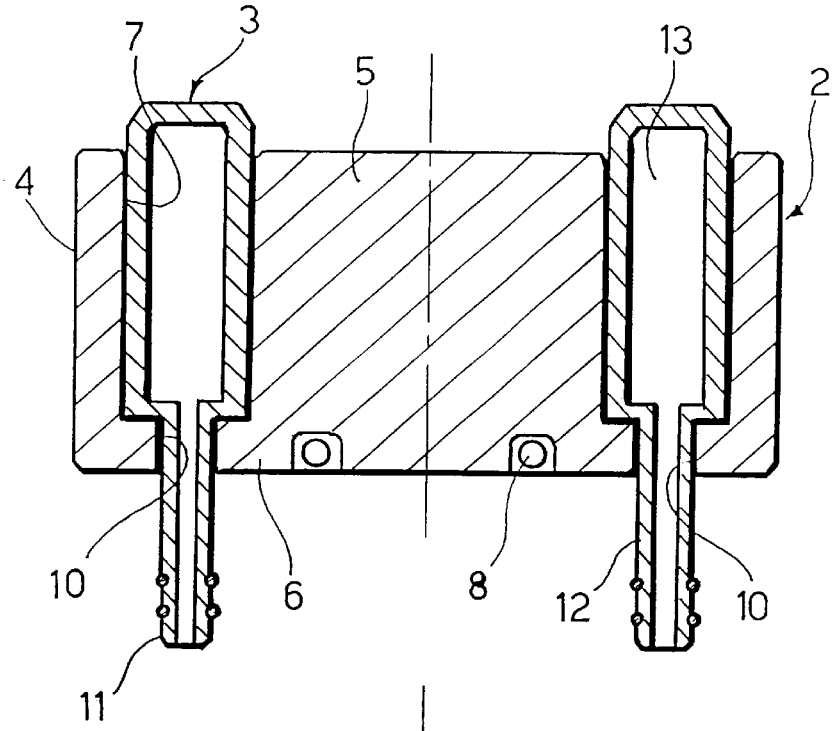
FIG. 4 is a cross-section along the line VI—VI of FIG. 3.
Figure 3:
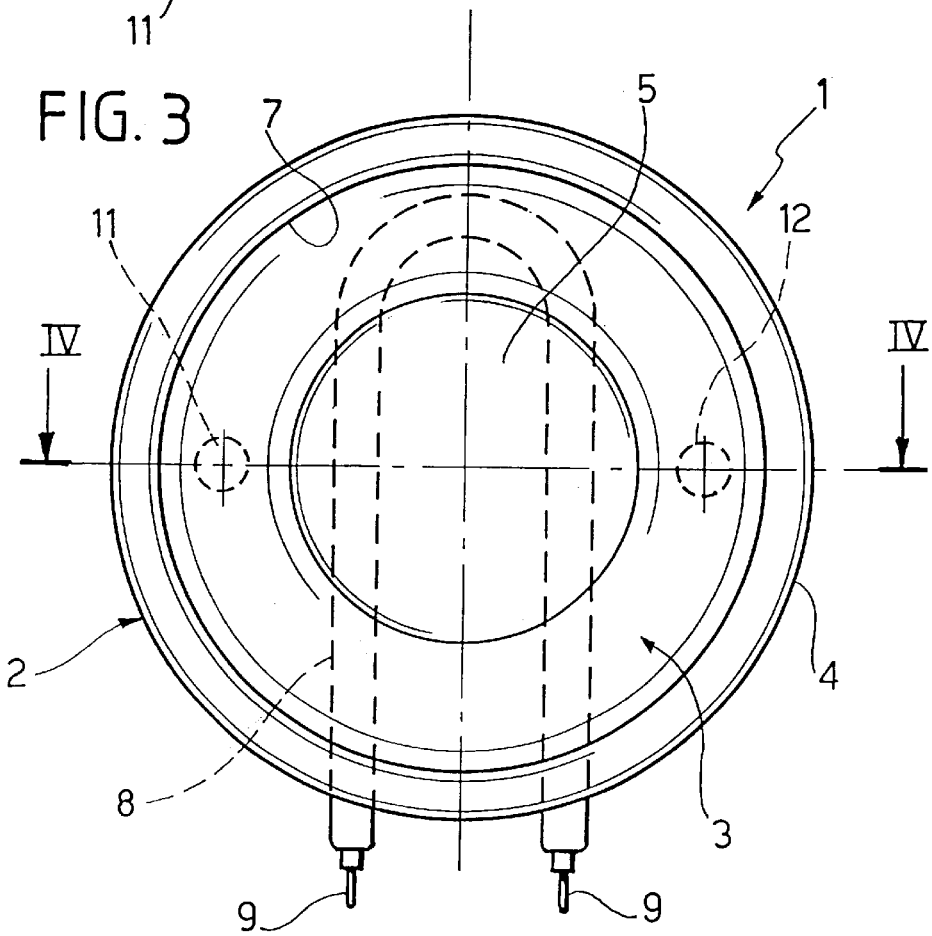
FIG. 3 is a layout of FIG. 1.
Figure 1A:
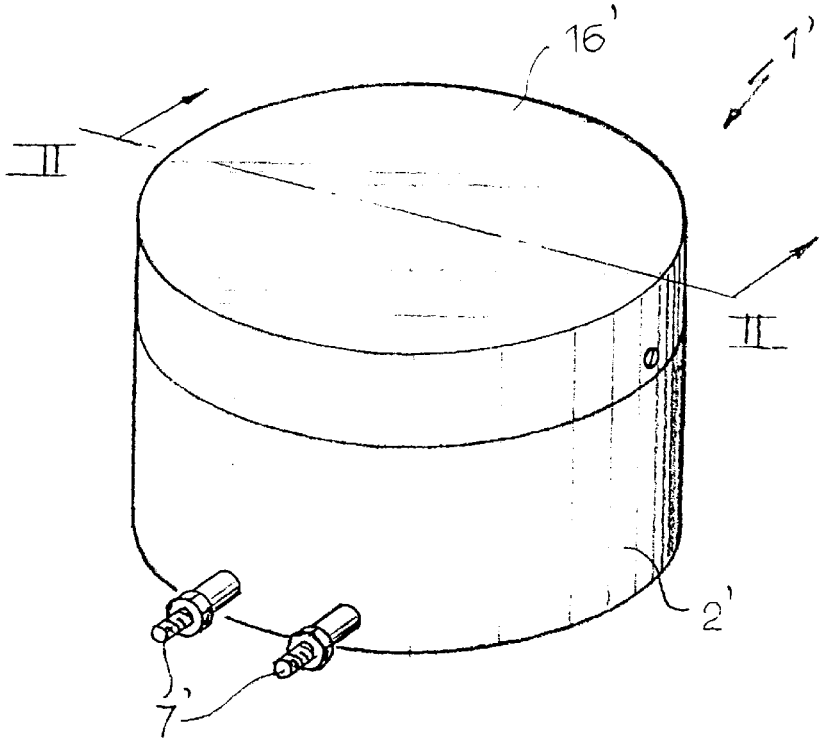
FIG. 1A is a schematic perspective view of a second possible form of implementation of the disposable steam generator made according to the present invention.

The base 2 presents a generally cylindrical shape with a circular cross-section (which could however be different, e.g. elliptic or polygonal) and is composed of a single piece of a metal that has a first thermal dilation coefficient, which could conveniently be aluminium. Said base 2 is composed of a thick outer circumferential wall 4, with a solid cylindrical element 5 placed coaxially inside the outer wall 4, and a bottom 6 (FIG. 4). Between the outer wall 4 and the central element 5 there is a ring-shaped cavity 7, closed on one side by the bottom 6.

There is a heating element 8, driven under pressure into the bottom 6, with its connector terminals 9 projecting radially from the base 2.

Moreover, there are two diametrically opposite through holes 10 in the bottom 6, the purpose of which will be explained later on.

The hollow body 3 is also composed of a single piece of metal conveniently having a lower thermal dilation coefficient than that of the base 2, such as brass. Said hollow body 3 has a circular ring-shaped configuration perfectly complementary with that of the ring-shaped cavity 7 in the base 2, inside which it is designed to fit tightly, i.e. with a certain degree of interference, but in such a manner as to be disconnected and axially withdrawn, when necessary.

As shown clearly in the drawings, when it is inserted in the ring-shaped cavity 7, the outside of the hollow body 3 is circumferentially in contact with the inner surface of the wall 4, the inside is in contact with the outer surface of the central element 5, and the bottom is in contact with the bottom 6 that delimits the cavity 7.

Numerals 11 and 12 are used to indicate two axial tubular connectors projecting from the bottom of the hollow body 3 adhering to the bottom 6 of the base 2 and inserted through the holes 10 in the base. The connectors 11 and 12 are designed, in practice, to be coupled under pressure with corresponding connectors respectively for the delivery of the water and for the discharge of the steam to and from the ring-shaped cavity of the body 3, indicated by the numeral 13, which forms the steam chamber in the steam generator 1.

The end of the hollow body 3 on the opposite side to the bottom 6 of the base 2, conveniently extends slightly from the base, for reasons which will be explained later on.

In practical use, as already mentioned previously, the base 2 is attached permanently to the steam appliance, with the hollow body 3 that forms the steam chamber 13 inserted in the ring-shaped cavity 7, but accessible from the outside, e.g. through a special hatch that can be opened in the appliance.

In operation, the heating of the base 2 by the electric heating element 8 is propagated and transmitted to the hollow body 3 in an effective and optimal manner, mainly by conduction, thanks to the ample circumferential surfaces of mutual contact between said hollow body 3 and the base 2. The steam production inside the chamber 13 thus takes place just as if the heating element 8 were attached directly to the hollow body 3. This effect is further accentuated by the different thermal dilation coefficient, which is higher for the base 2 and lower for the hollow body 3, particularly in relation to the phase of cold water delivery to the chamber 13 through the tubular connector 11.

When the operation of the steam generator 1 deteriorates due to scale build-up inside the hollow body 3, the latter can be easily and rapidly removed and replaced with an identical spare body, clearly without having to remove the heating element 8.

The hollow body 3 can easily be removed, once it has cooled down, by sliding it axially away from the ring-shaped cavity 7 in the base 2. This operation is facilitated by the fact that the end of the hollow body 3 projects from the base 2, and can be conveniently designed for the application of an extractor device. Said extractor device may, for instance, consist of a threaded grip which can be screwed onto an outside thread (not illustrated) on the projecting end of the hollow body 3, or any other system functioning in an equivalent manner.

The fitting of the spare hollow body 3 is equally straightforward and easy, using the tubular connectors 11 and 12 as centering elements with respect to the holes 10 in the bottom 6.

For the purpose of ensuring a tight coupling between the hollow body 3 and the base 2 devices can be provided to ensure a mutual axial thrust, such as elastic clips, which are not illustrated in the drawings.

It will appear evident from the previous description that the disposable steam generator made according to the present invention ensures the functional efficiency of the steam appliance on which it is installed to be restored by means of a straightforward replacement of a basic, low-cost component, without the need for any action on the heating element 8 and the corresponding electric connections.

Referring now to FIGS. 1A–3A, in a second form of implementation of the invention (currently considered as the preferred form) the numeral 1' as a whole indicates a disposable steam generator made according to this invention, here again applicable, for instance, to irons, cleaners, coffee makers and other such domestic appliances that use steam. The steam generator 1' essentially includes a base 2', designed to be attached permanently to the steam appliance (using conventional methods that, for the sake of simplicity, are not illustrated here since they are easily accessible to any technician in this sector), and a hollow body 3' designed for a rapid coupling, in a removable and replaceable fashion, with the base 2'.

The base 2' presents a generally cylindrical shape with a circular cross-section (which could however be different, e.g. elliptic or polygonal) and is composed of a single piece of a metal that has a first thermal dilation coefficient, which could conveniently be aluminium. Said base 2' is composed of a deep cavity 4' with a conical surface. It is worth noting that the surface of the cavity 4' could have a different configuration, e.g. a surface that is partially conical and partially flat, a surface graded in steps or the like, or it could even be prismatic (e.g. pyramid-shaped), with flat sides.

On the surface of the cavity 4' there are two axial passages 5' that pass through the base 2' and are provided for connection to the water inlet and the steam outlet, respectively.

Underneath the cavity 4' there is an electric heating element 6' (generally in a "U" shape, for instance) incorporated by high-pressure driving in the base 2'. The connector terminals for the electric heating element 6', indicated as 7', extend radially from the base 2'.

The hollow body 3' is made of a metal having a suitable thermal dilation coefficient that is lower than that of the base 2', e.g. brass. The majority 13' of said hollow body 3' has a shape that is perfectly complementary (and thus conical in the example) to the shape of the cavity 4' in the base 2' inside which it is designed to fit tightly, in close contact to allow for heat transfer, but in a manner so that it can, if necessary, be axially uncoupled and withdrawn. The conical part 13' may be without a tip or apex.

Figure 2A:
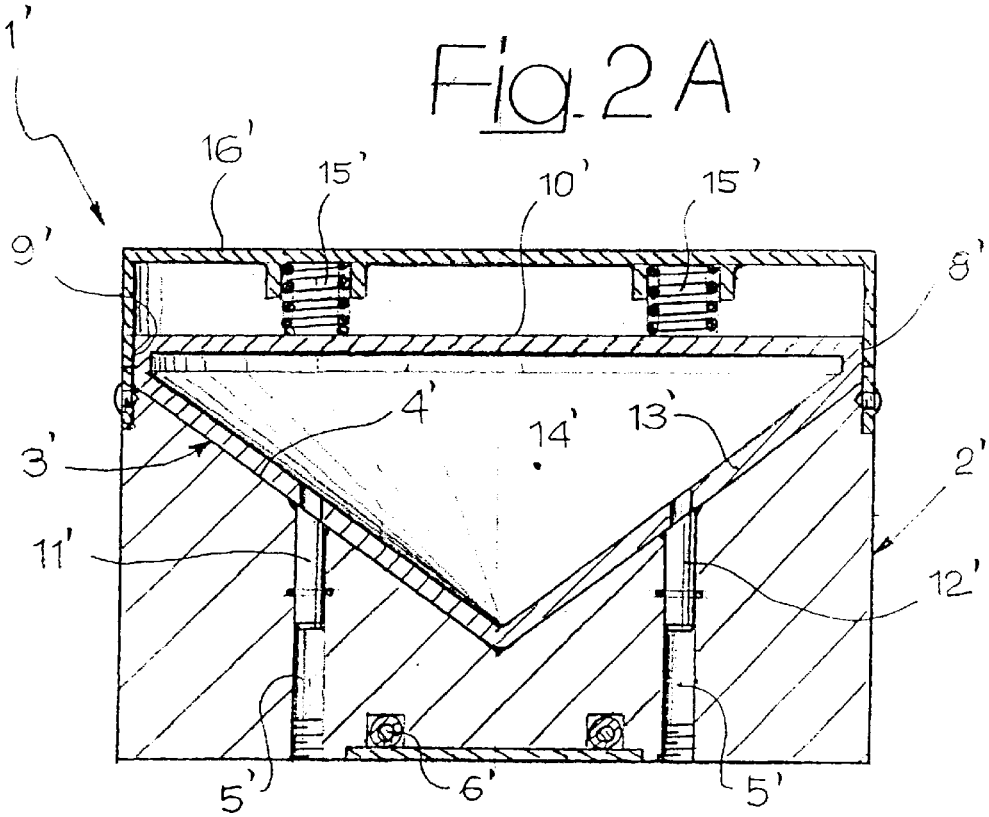
FIG. 2A is a vertical cross-section along the line II—II of FIG. 1A.
Figure 3A:
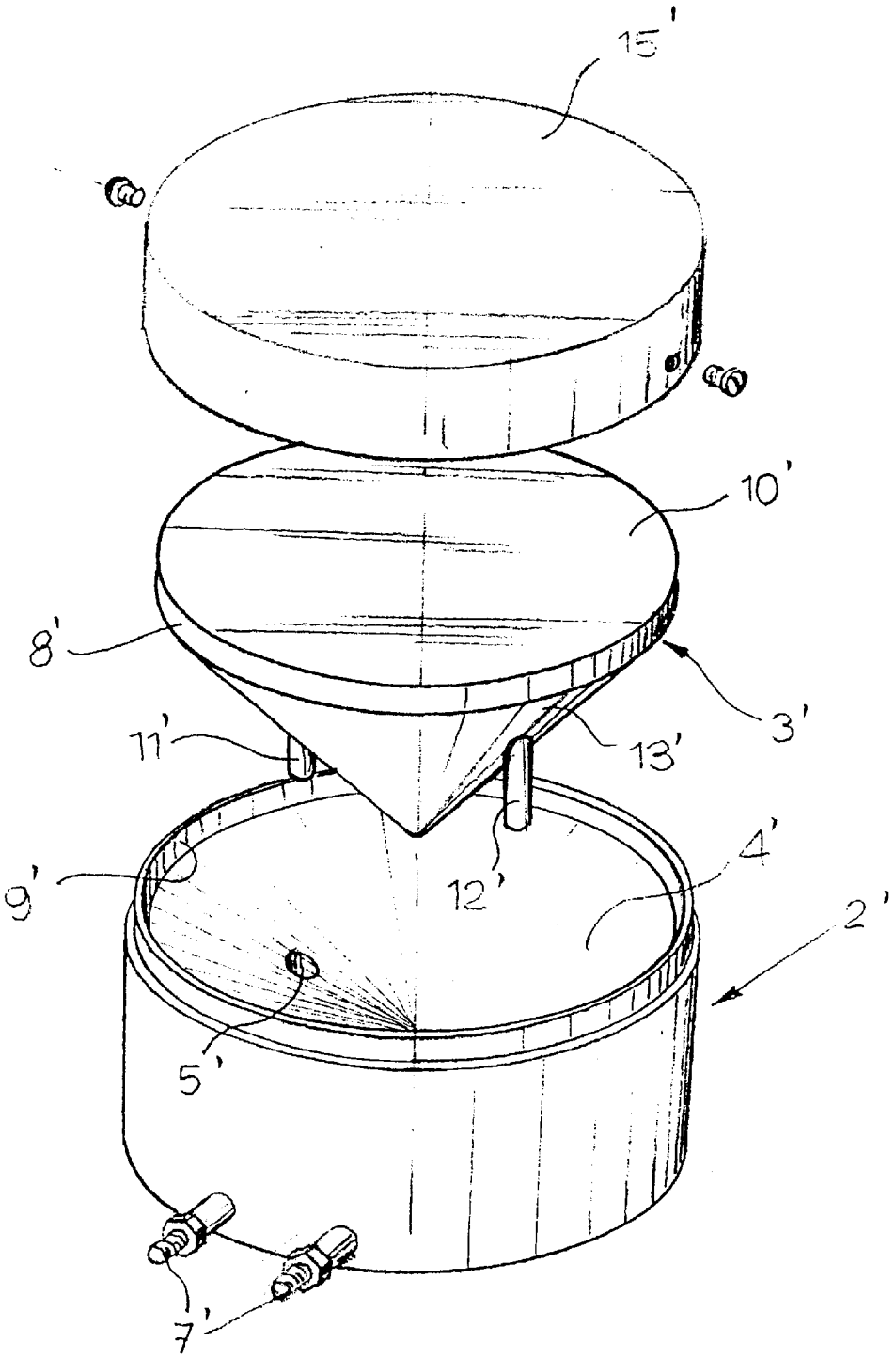
FIG. 3A is an exploded view of FIG. 1A.

As appears evident from FIG. 2A, when it is inserted in the cavity 4' in the base 2', the hollow body 3' can have a side wall 8' circumferentially in contact with the inside surface 9' of the base 2', with its top 10', which is normally flat, on the opposite side of the base 2'.

Numerals 11' and 12' are used to indicate two axial tubular connectors projecting from the conical part 13' of the hollow body 3' and coupled with watertight connections to the passages 5' in the base 2'. The connectors 11' and 12' are designed, in practice, to allow respectively for the delivery of water and the discharge of steam to and from the cavity of the body 3', indicated as 14', which forms the steam chamber in the steam generator 1'.

In order to achieve a total surface contact for the heat transfer by conduction between the conical cavity 4' in the base 2' and the conical part 13' of the hollow body 3', the invention provides for the use of a system of mutual axial thrust. In the case of the example illustrated, said system is flexible and includes a helicoidal compression springs 15' reacting between the flat top 10' of the hollow body 3' and a removable cover 16' attached to the base 2', for instance in line with the wall 9' of the base 2'. The system of mutual axial thrust could also be of a non-elastic type.

In practice, as already mentioned previously, the base 2' is attached permanently to the steam appliance, with the hollow body 3' that forms the steam chamber 14' inserted in the cavity 4' and pressed inside said cavity by the action of the springs 15'. The steam generator 1', and particularly the area corresponding to the cover 16', is accessible from the outside, e.g. through a special hatch that can be opened in the appliance In operation, the heating of the base 2' by the electric heating element 7' is propagated and transmitted to the hollow body 3' in an effective and optimal manner, mainly by conduction, thanks to the ample circumferential surfaces of mutual contact (between the wall of the cavity 4' and the wall of the conical part 13') between said hollow body 3' and the base 2'. The steam production inside the chamber 14' thus takes place just as if the heating element 6' were attached directly to the hollow body 3'. This effect is further accentuated both by the presence of the springs 15', and possibly by the different thermal dilation coefficient, which is higher for the base 2' and lower for the hollow body 3'.

When the operation of the steam generator 1' deteriorates due to the build-up of scale inside the hollow body 3', the latter can be easily and quickly removed and replaced with an identical spare body, clearly without any need to remove the base 2' with the heating element 6'.

The hollow body 3' can easily be removed, once it has cooled down, by sliding it axially away from the 4' in the base 2', after removing the cover 16' with the springs 15'. The fitting of the spare hollow body 3' is equally straightforward and easy, using the tubular connectors 11' and 12' as centering elements with respect to the passages 5' in the base 2'.

Here again, therefore, the function of the steam appliance to which the steam generator 1' is attached can be promptly restored thanks to the straightforward replacement of a basic, low-cost component, without the need for any action on the heating element 8' and the corresponding electric connections.

Of course, without departing from the scope of the invention, the construction details and implementations can vary considerably with respect to the version described and illustrated here, without departing from the context of the present invention as defined in the claims that follow. Thus, as already explained, the surfaces of mutual contact between the base 2' and the hollow body 3', instead of being essentially conical, can equally well be, at least in part, cylindrical, flat or in steps, or even prismatic. Moreover, the conical cavity 4' can be less deep than the one illustrated here by way of example, and can be replaced by a simple cylindrical insert (with a circular, square or polygonal cross-section), or even simply by a flat seat. In this case, the hollow body 3' will have a complementary shape, i.e. cylindrical (with a correspondingly circular, square or polygonal cross-section) having a greater crosswise dimension than its axial dimension so as to have an ample bottom in contact with the seat 4'. By such an alternative shaping, an example of which shall be disclosed hereafter with reference to FIG. 1C, the presence of the springs 15', or a functionally equivalent pressure system, coming to bear on the top of the hollow body 3', i.e. on the side opposite the above-mentioned bottom, will be considered particularly useful to ensure the best heat transfer between the base 2' and the hollow body 3'.

Figure 1B:
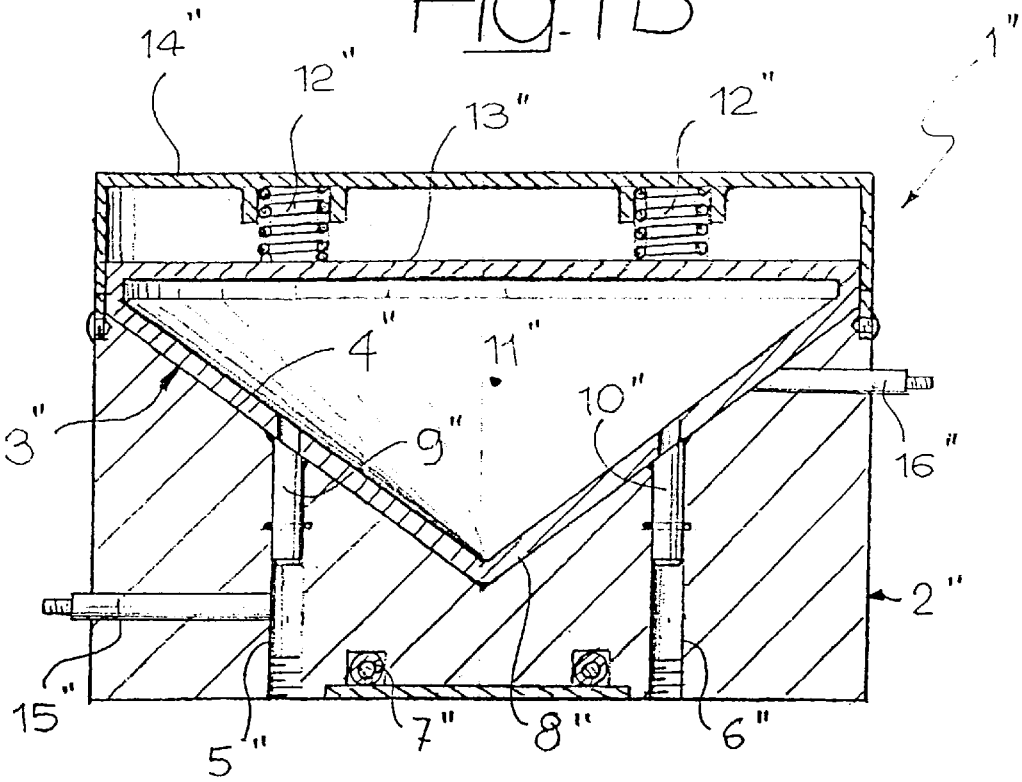
FIG. 1B shows a variant of FIG. 2A.
Figure 2B:
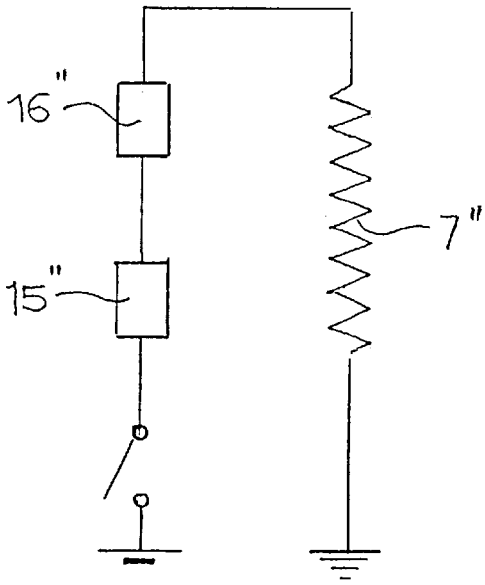
FIG. 2B is a wiring diagram for the electric circuit for powering the steam generator in FIG 1B.

Referring now to FIGS. 1B and 2B, the numeral 1" is used to indicate a steam generator made according to the invention that comprises a variant of the form of implementation previously described with reference to FIGS. 1A–3A.

Here again, the base 2" of the steam generator 1" has a generally cylindrical shape with a circular cross-section (which could nonetheless be different, e.g. elliptical or polygonal) and is composed of a metal element (normally aluminium) with a deep cavity 4" with a conical surface. It is worth noting that the surface of the cavity 4" could have a different configuration, e.g. a surface that is partially conical and partially flat, a surface graded in steps or the like.

On the surface of the cavity 4" there are two axial passages 5" and 6", which pass through the base 2" and are provided for connection to a water inlet and a steam outlet, respectively.

Underneath the cavity 4" there is an electric heating element 7" incorporated by high-pressure driving in the base 2".

The hollow body 3", is also made of metal and the majority 8" of the body has a conical shape that is perfectly complementary to the shape of the cavity 4" in the base 2", inside which it is designed to fit tightly, in close contact to allow for heat transfer, but in a manner so that it can, if necessary, be removed and replaced.

Numerals 9" and 10" are used to indicate two axial tubular connectors projecting from the conical part 8" of the hollow body 3" and coupled with watertight connections to the passages 5" and 6", respectively, in the base 2". The connectors 9" and 10" are designed, in practice, to allow respectively for the delivery of water and the discharge of steam to and from the cavity of the body 3", indicated as 11", which forms the steam chamber of the steam generator 1".

Here again, for the purpose of achieving a total surface contact for the heat transfer by conduction between the conical cavity 4" in the base 2" and the wall 8" of the hollow body 3", the invention provides for the use of a flexible system of mutual axial thrust, comprising helicoidal compression springs 12" placed between the flat top 13" of the hollow body 3" and the removable cover 14" attached to the base 2".

FIG. 2B represents the wiring diagram for the electric circuit powering the heating element 7": according to the invention, said circuit includes a first thermostatic switch 15" and a second thermostatic switch 16", connected in series and with the heating element 7", and normally closed.

Both the thermostatic switches 15" and 16" are housed inside corresponding seats in the base 2". The first thermostatic switch 15", characterized by an opening temperature threshold between 90 and 150° C., is positioned on the side of the water inlet 5" and is therefore exposed, in operation, to a the cooling effect of the flow of water delivered to the steam generator.

The second thermostatic switch 16", characterized by an opening temperature threshold between 170 and 200° C., on the other hand, is situated on the side of the hollow body 3" and is directly sensitive to the temperature inside the steam chamber 11".

It is important to note that the electric power supply circuit for the heating element 7" also normally includes an additional safety temperature limiter of a conventional type that, for the sake of simplicity, is not represented in the drawings.

In operation, the heating of the base 2" by the heating element 7" is propagated and transmitted to the hollow body 3" thanks to the ample circumferential surfaces of mutual contact (between the wall of the cavity 4" and the wall of the conical part 8") between said hollow body 3" and the base 2". In steady-state operation the thermostatic switch 15" cyclically opens whenever it reaches its opening temperature threshold, then rapidly closes again due to the cooling effect of the water delivered through the passage 5". By means of a suitable balance between the electric power supply, the heating mass and the quantity of water delivered, the temperature inside the steam chamber 11" is normally kept high, but below the opening temperature threshold of the second thermostatic switch 16": in this way, steam production is virtually continuous, smooth and constant, which ensures the optimal performance of the appliance on which the steam generator 1" is installed.

When the operation of the steam generator 1" deteriorates due to the build-up of scale inside the hollow body 3", the latter can, here again, be easily and rapidly removed and replaced with an identical spare body, clearly without any need to remove the base 2" with the heating element 7" and the two thermostatic switches 15" and 16".

The above-described arrangement for the two thermostatic switches 15" and 16" is naturally also applicable to steam generators other than the type illustrated in FIGS. 1B and 2B, such as the one described with reference to FIGS. 1–4.

Figure 1C:
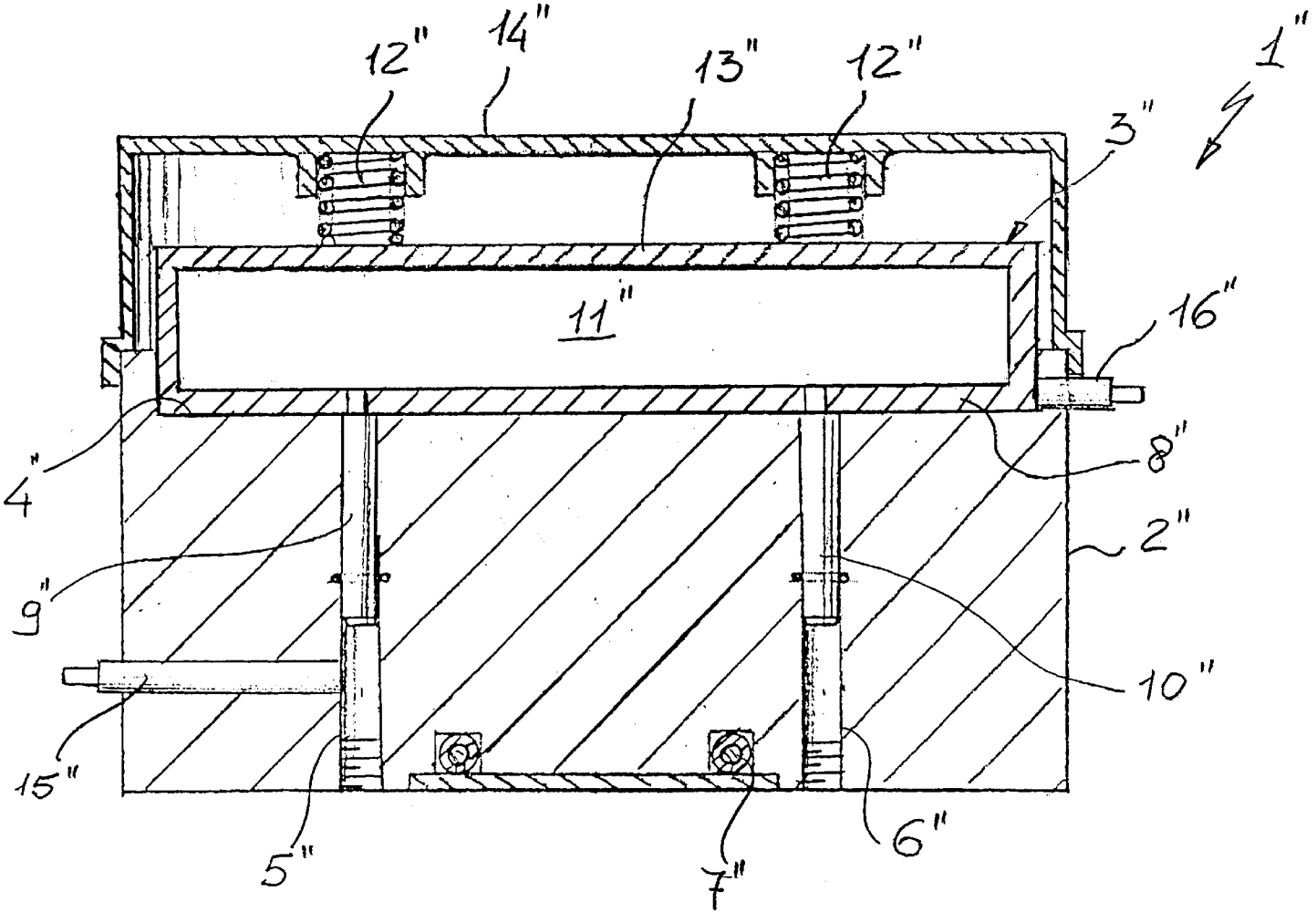
FIG. 1C shows a further variant of FIG. 2A.

FIG. 1C depicts a variant of FIG. 1B: in this figure parts identical or similar to those already disclosed with reference to FIG. 1B are designated by the same reference numerals.

In this embodiment the base 2" of the steam generator 1" has a generally cylindrical shape with a circular cross section (which may however be different, e.g. quadrangular, polygonal, elliptical, etc.) and is formed on one side, conveniently but not necessarily the upper side, with a seat 4". This seat 4" is constituted in the shown example by a recess having a limited depth, for instance with a circular design: it is however to be pointed out that in alternative the seat 4" may be formed either by a deeper cavity, or by a mere depression even less deep than the shown seat, having any geometrical shape. Anyway the wall of the seat 4" shall generally be plane and smooth, as in the case of the shown example, or may be provided with annular or linear corrugations or ribbings.

The hollow body 3", also made of metal, has a flattened cylindrical design, i.e. with a radial dimension much greater than its axial dimension, and a cross section complementary to thet of the seat 4", within which it fits tightly, in close heat-transfer contact but so as to be—whenever necessary—quickly released and replaced.

The bottom wall 8" of the hollow body 3" has normally the same surface arrangement of the seat 4" of the base 2", i.e. may also be provided with annular or linear corrugations or ribbings.

The thrust system providing the surface contact ensuring full heat transfer by conduction between the seat 4" and the bottom wall 8" of the hollow body 3" is even in this case consisting of helical compression springs 12" interposed between the upper wall 13" of the hollow body 3" and the cover 14" secured to the base 2" in a releasable way, for instance by means of a threaded or bayonet coupling or equivalent systems.

It is to be pointed out that the thrust system may be differently designed and for instance include cam or toggle devices, not necessarily elastic.

Naturally, the details of construction and the embodiments may be widely varied with respect to what has been disclosed and illustrated, without thereby departing from the scope of the present invention. Thus, by way of example, the cross section of the cylindrical hollow body 3", and correspondingly the plan design of the seat 4", may be non only circular but also quadrangular, polygonal, elliptical, etc.

Moreover, while in the case of the shown examples the close heat-transfer contact fit between the base 2" and the hollow body 3" is carriad out axially, the same effect may be accomplished in a radial or tranverse direction, for instance forming the base 2" with two or more angular sectors designed to be mutually closed and opened around the hollow body 3". in This case the heat-transfer contact can be provided, in alternative or in addition to the bottom wall 8", in correspondence of the lateral wall of the hollow body 3", which shall in this case have, contrary to the shown example, an axial size greater than its radial size.

What is claimed is:

1. Disposable steam generator (1) for domestic steam appliances, comprising a base (2), a hollow body (3) made of heat-conducting material that defines a steam chamber (13) having an inlet for water (11) and an outlet for steam (12), and at least one electric heating element (8), characterized by the fact that:

said base (2) is designed to be attached permanently to the steam appliance and said hollow body (3) is designed for a rapid connection, in a replaceable manner, to the base (2), said at least one electric heating element (8) is attached to the base (2), said base (2) is also made of heat-conducting material and has a seat (7), the hollow body (3) has at least in part a shape complementary to that of said seat (7) in the base (2) and fits tightly, in close heat-transfer contact and in a releasable fashion, with and said seat (7).

2. Steam generator according to claim 1, characterized by the fact that said hollow body (3) has, for the most part, a shape that is complementary to that of said seat (7) in the base (2).

3. Steam generator according to claim 1, characterized by the fact that said seat is in the form of the deep cavity (7; 4'; 4").

4. Steam generator according to claim 3, characterized by the fact that said hollow body (3) and said cavity (7) in the base (2) both have a ring shape.

5. Steam generator according to claim 4, characterized by the fact that said ring-shaped cavity (7) in the base (2) is defined by a ring-shaped outer wall (4) and by an inner wall (5), and by the fact that said hollow body (3), when fitted into said ring-shaped cavity (7), comes into close contact to ensure heat transfer essentially by conduction with said outer and inner walls (4,5) of the base (2).

6. Steam generator according to claim 5, characterized by the fact that said ring-shaped cavity (7) in the base (2) is also delimited by a bottom (6), and by the fact that said hollow body (3), when fitted inside said ring-shaped cavity (7), also comes into contact with said bottom (6) in the base (2) for heat transfer essentially by conduction.

7. Steam generator according to claim 6, characterized by the fact that said at least one electric heating element (8) is incorporated in said bottom (6) in the base (2).

8. Steam generator according to claim 6, characterized by the fact that said water inlet (11) and said steam outlet (12) are composed of axial tubular connectors projecting through corresponding axial holes (10) passing through the bottom (6) in the base (2).

9. Steam generator according to claim 5, characterized by the fact that said inner wall in the base (2) is defined by a solid central element (5).

10. Steam generator according to claim 9, characterized by the fact that said outer wall (4), said solid central element (5) and said bottom (6) are composed of a single piece of a metal with a first thermal dilation coefficient, and said hollow body (3) is made of a metal with a second thermal dilation coefficient.

11. Steam generator according to claim 10, characterized by the fact that said first thermal dilation coefficient is greater than said second thermal dilation coefficient.

12. Steam generator according to claim 1, characterized by the fact that said base (2) and said hollow body (3) have a circular cross-section.

13. Steam generator according to claim 1, characterized by the fact that said hollow body (3) is designed for the application of an extractor device.

14. Steam generator (1') according to claim 3, characterized by the fact that said cavity (4') in the base (2') and said part (13') of the hollow body (3') are substantially conical in shape.

15. Steam generator according to claim 1, characterized by the fact that said seat (4') in the base (2') and said part (13') of the hollow body (3') are substantially cylindrical in shape.

16. Steam generator according to claim 1, characterized by the fact that said seat (4') in the base (2') and said part (13') of the hollow body (3') are substantially flat in shape.

17. Steam generator according to claim 1, characterized by the fact that it also includes thrust means (15'; 12") designed to axially press said hollow body (3, 3'; 3") and said base (2; 2'; 2") against each other.

18. Steam generator according to claim 17, characterized by the fact that said thrust means (15'; 12") are elastic.

19. Steam generator according to claim 14, characterized by the fact that said at least one electric heating element (6') is incorporated underneath said seat or cavity (4') in the base (2').

20. Steam generator according to claim 14, characterized by the fact that said water inlet (11') and said steam outlet (12') are composed of axial tubular connectors projecting from said conical part (13') of the hollow body (3') for coupling with a watertight seal with the corresponding axial passages (5') in said base (2').

21. Steam generator according to claim 14, characterized by the fact that said base (2') is composed of a single piece of a metal with a first thermal dilation coefficient, and said hollow body (3') is made of a metal with a second thermal dilation coefficient.

22. Steam generator according to claim 21, characterized by the fact that said first thermal dilation coefficient is greater than said second thermal dilation coefficient.

23. Steam generator according to claim 14, characterized by the fact that said base (2') and said hollow body (3') have a circular, square, elliptical or polygonal cross-section.

24. Steam generator (1") according to claim 1, characterized by the fact said hollow body has a transverse size much greater than its axial size.

25. Steam generator (1") according to claim 1, in which said electric heating element (7") can be connected to a power supply source by means of normally-closed thermostatic safety switch means, characterized by the fact that said thermostatic switch means include a first thermostatic switch (15") with a first opening temperature threshold whose operation is associated with said water inlet (5"), and a second thermostatic switch (16") with a second opening temperature threshold, substantially higher than said first opening temperature, operatively associated with said steam chamber (11").

26. Steam generator according to claim 25, characterized by the fact that said first opening temperature is between approximately 90 and 150° C. and said second opening temperature is approximately between 170 and 200° C.

* * * * *